United States Patent [19]

Goffe, deceased et al.

[11] 4,095,981

[45] Jun. 20, 1978

[54] PHOTOGRAPHIC MATERIAL CONTAINING AN ENERGY-SENSITIVE ORGANIC O-NITROARYLIDENE DYE AND PHYSICAL DEVELOPMENT PROCESS OF FORMING AN IMAGE WITH SAID MATERIAL

[75] Inventors: Charles A. Goffe, deceased, late of Brockport, N.Y., by Patricia Anne Goffe, executrix; Philip W. Jenkins; David M. Sturmer, both of Rochester, N.Y.

[73] Assignee: Eastman Kodak Company, Rochester, N.Y.

[21] Appl. No.: 689,326

[22] Filed: May 24, 1976

[51] Int. Cl.[2] ..... G03C 1/00; G03C 5/24

[52] U.S. Cl. ..... 96/48 PD; 96/48 HD; 96/88

[58] Field of Search ..... 96/88, 48 PD, 95, 94 R, 96/101, 48 HD

[56] References Cited

U.S. PATENT DOCUMENTS

| | | | |
|---|---|---|---|
| 3,250,618 | 5/1966 | Stewart et al. | 96/101 |
| 3,753,717 | 8/1973 | Titov et al. | 96/88 |
| 3,984,248 | 10/1976 | Sturmer | 96/101 |

*Primary Examiner*—Won H. Louie, Jr.
*Attorney, Agent, or Firm*—Richard E. Knapp

[57] ABSTRACT

A photographic material comprises certain dyes that, on exposure, release a species which catalyzes the reduction of silver salt oxidizing agents in the presence of organic reducing agents. The photographic material, after imagewise exposure, is heated or processed in a physical developer to develop the image.

15 Claims, No Drawings

PHOTOGRAPHIC MATERIAL CONTAINING AN ENERGY-SENSITIVE ORGANIC O-NITROARYLIDENE DYE AND PHYSICAL DEVELOPMENT PROCESS OF FORMING AN IMAGE WITH SAID MATERIAL

BACKGROUND OF THE INVENTION

1. Field of the Invention

This invention relates to certain dyes in photographic elements, compositions, and processes and preferably in photothermographic elements, compositions, and processes which do not require the presence of a silver halide to provide a developable latent image using a reasonably short exposure time. In one of its aspects, it relates to photographic elements containing these dyes. In another of its aspects, it relates to a photographic composition containing the described dyes. A further aspect relates to a method of developing a latent image in the described photothermographic element by heating the element. A still further aspect relates to the method of physically developing photographic elements containing the dyes. The photographic elements, compositions and processes of the invention are useful in the graphic arts.

2. Description of the Prior Art

Photographic materials are known containing silver halide which can be imagewise exposed and processed in a physical developer or, if photothermographic, can be heat developed to form photographic line and halftone reproductions. Such photographic materials, after exposure, can be developed by conventional physical developers or, if photothermographic, can be heated overall to provide a developed image in the absence of separate processing solutions. If a photothermographic process is to be used, reducing agents are necessary in the imaging composition. Reducing agents which have been employed with silver halide in photothermographic materials are described, for example, in Belgian Pat. No. 765,452, issued May 28, 1971; Belgian Pat. No. 765,602, issued May 29, 1971; Belgian Pat. No. 765,601, issued May 28, 1971; Belgian Pat. No. 766,590, issued June 15, 1971; Belgian Pat. No. 766,589, issued June 15, 1971; Belgian Pat. No. 722,371, issued Oct. 15, 1971; U.S. Pat. No. 3,152,904 of Sorenson et al., issued Oct. 13, 1964; U.S. Pat. No. 3,152,903 of Sorenson et al., issued Oct. 13, 1964; U.S. Pat. No. 3,457,075 of Morgan et al, issued July 22, 1969; U.S. Pat. No. 3,392,020 of Yutzy et al, issued July 9, 1968 and British Pat. specification No. 1,161,777 published Aug. 20, 1969.

The use of photographic silver halide to achieve high contrast films is undesirable. The high expense and shortage of silver has resulted in a continuing search for substitutes. However, at this time no material has been found to provide the high contrast provided by photographic silver halide at reasonable exposure times.

One photothermographic material without silver halide is described in Lokken U.S. Pat. No. 3,409,438. This material contains certain reducing agent precursors to form an image after imagewise exposure and heat development. These photothermographic elements, however, are not capable of forming high contrast images after being exposed for only short periods of time.

Use of certain nitrobenzylidene dyes as impregnates for support materials for photograhic elements containing silver halide is described in Belgian Pat. No. 788,279 published Feb. 28, 1973. A non-silver halide-containing photothermographic element has not been found that is capable of being exposed for a short time and heat developed to a high-contrast image.

Accordingly, there has been a continuing need to provide improved photographic and photothermographic elements, compositions and processes that do not contain silver halide to provide high contrast images with reduced exposure time.

SUMMARY OF THE INVENTION

It has been found, according to the invention, that a high-contrast image can be obtained using a relatively short exposure in a non-silver halide, photographic element and composition comprising cetain energy-sensitive organic dyes. The energy-sensitive dye can be employed in a photographic composition comprising the energy-sensitive dye and a silver salt oxidizing agent, as described herein, which can be processed in a physical developer bath or in a photothermographic non-silver halide material comprising an oxidation-reduction image-forming combination comprising a silver salt oxidizing agent and a reducing agent and a binder. The dye enables the omission of silver halide from the described photographic or photothermographic material.

DETAILED DESCRIPTION OF THE INVENTION

The photographic elements and composition of this invention comprise energy-sensitive dyes as described below, a silver salt oxidizing agent and a binder. The compositions can be coated on a support as described below and imagewise-exposed to acitinic or visible light to form catalytic sites which can then be physically developed using conventional physical developing baths.

The dye which is a reducing agent precurser is typically present in the photographic composition at a concentration range from about $10^{-1}$ mole to about $10^{-5}$ mole of energy-sensitive dye per mole of silver in the silver salt oxidizing agent and preferably at a concentration ranging from about $10^{-2}$ to about $10^{-4}$ mole per mole of silver.

Any of the binders hereinafter described can be used in the photographic composition. The preferred binder is gelatin. Conventional addenda can also be added to the photographic composition.

After exposure of the described photographic composition, the resulting latent image can be developed by immersing in a physical developer bath.

The physical development may take place in any conventional physical developing bath. The physical development bath generally contains metal ions in salt form and a reducing agent for the metal ions. Typical physical developer solutions are well-known (see Hornsby, *Basic Photographic Chemistry,* (1956) 66, and Mees and James, ed., *The Theory of the Photographic Process,* 3rd edition (1966), 329–331, and U.S. Pat. No. 3,650,748 by Yudelson et al. issued Mar. 21, 1972) and contain the metallic ions such as silver, copper, iron, nickel or cobalt necessary to form a visible image at and in the vicinity of the nucleating centers.

The preferred metal salts employed as the source of metal for physical development are water-soluble salts such as silver nitrate, cupric salts such as copper chloride, copper nitrate, copper sulfate, copper formate, copper acetate and the like, and nickel salts such as nickel chloride, nickel bromide, nickel sulfate, nickel nitrate, nickel formate and the like.

Typical reducing agents used in the physical developer include, for example, polyhydroxy-substituted aryl compounds such as hydroquinones, catechols, and pyrogallols; ascorbic acid derivatives; aminophenols; p-phenylenediamines; and the like developing agents used in the photographic art. Particular examples of reducing agents for physical developer solutions are 2-methyl-3-chlorohydroquinone, bromohydroquinone, catechol, 5-phenylcatechol, pyrogallol monomethyl ether (1-methoxy-2,3-dihydroxybenzene), 5-methylpyrogallol monomethyl ether, isoascorbic acid, N-methyl-p-aminophenol, dimethyl-p-phenylenediamine, 4-amino-N,N-di(n-propyl)aniline and 6-amino-1-ethyl-1,2,3,4-tetrahydroquinoline. Borane reducing agents such as amineboranes, borohydride and the like may also be used.

The proportions in which the various components of the physical developer are present in the developer solution can vary over a wide range. Suitable concentrations of reducible heavy metal salt can range from about 0.01 mole to about 1.0 mole of metal salt per liter of solution. The upper limit of concentration is dependent upon the solubility of the particular metal salt employed. Preferably, the solution is about 0.1 molar to about 0.3 molar with respect to the heavy metal salt. If a complexing agent is used, the relative proportions of metal salt and complexing agent are dependent upon the particular heavy metal salt or salts and the particular complexing agent or agents which are employed. As a general rule, sufficient complexing agent should be incorporated to "tie up" the reducible heavy metal ions which are in solution and to lessen the tendency of these metal ions to be reduced prior to use of the developer solution. Depending upon the particular heavy metal salt and the particular complexing agent which is employed, the amount of complexing agent present typically can vary from about 0.2 mole to about 10 moles of complexing agent per mole of metal salt present. Typically, the reducing agent can be present in amounts from about 0.01 mole to about 5 moles of reducing agent per mole of metal salt present in the solution. In order to permit the developer solution to be utilized for its maximum life, at least one equivalent of reducing agent should be present in the solution for each equivalent of reducible heavy metal salt. This preferred processing baths contain a silver halide such as silver chloride.

The photothermographic element and composition of this invention comprise energy-sensitive dyes as described herein, a silver salt oxidizing agent, a non radiation-sensitive reducing agent and a binder.

Useful energy-sensitive dyes which upon exposure to actinic radiation catalyze the reduction of the silver compound to metallic silver are those dyes which require an exposure time of less than one minute to reach a silver density at least about 2.0 when subjected to the following test procedure:

1. a solution consisting of 208 mg silver pivalate and 50 ml xylene and a solution consisting of 286 mg 1,1'-bi-2 naphthol, 200 mg poly(vinyl butyral), 73.6 mg phthalimide and 50 ml xylene are mixed in a tube wrapped with foil to exclude room light;

2. a $1.0 \times 10^{-3}$ molar xylene solution of the dye to be tested is placed in a 1 mm quartz spectrophotometric cell and irradiated with a 75 watt bulb fitted with a UV cutoff filter;

3. 50 mμ of the solution of step (2) is added to the combined solution of step (1) and the reaction mixture is cooled; and 4. the silver density is determined.

Useful dyes which satisfy the described test according to the invention are typically o-nitro-substituted arylidene dyes. As employed herein the term "arylidene" refers to the group formed by an aryl group and a methine linkage, for example, benzylidene, cinnamylidene, and the like. These dyes contain an o-nitro-substituted aryl group joined through a methine chain linkage to a basic heterocyclic nucleus containing an electron-donating atom, typically a nitrogen, oxygen or sulfur electron-donating atom. The number of atoms joining the electron-donating atom and the aryl group is typically an even number. In a preferred form, the o-nitro-substituted aryl group is joined through an acyclic methine chain containing an odd number of methine groups to 5- or 6-membered basic, cyanine dye type heterocyclic nucleus. The heterocyclic nucleus can have additional carbocyclic and heterocyclic rings fused thereto. The o-nitro-substituted aryl group can contain a phenyl nucleus or can contain a nucleus formed by fused aromatic rings, such as naphthyl, and the like.

In a specific preferred embodiment of this invention the o-nitro-substituted dyes have the formula:

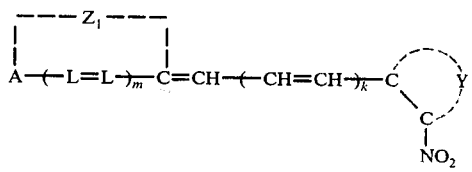

I.

wherein:

a. $k$ represents 0 or 1;

b. $m$ represents 0 or 1;

c. each L represents a methine group, including substituted methine groups, for example, —CH=, —C(CH$_3$)=, and the like;

d. A represents an electron donating moiety, such as oxygen (—O—), sulfur (—S—), or

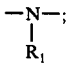

e. $R_1$ represents (1) an alkyl group having from 1 to 18 carbon atoms and preferably a lower alkyl group having from 1 to 4 carbon atoms (e.g., methyl, ethyl, propyl, isopropyl, butyl, secondary-butyl, isobutyl, tert-butyl, pentyl, hexyl, octyl, decyl, dodecyl, octadecyl); a sulfoalkyl group, preferably sulfo lower alkyl containing from 1 to 4 carbon atoms in the alkyl moiety (e.g., β-sulfoethyl, γ-sulfopropyl, γ-sulfobutyl, δ-sulfobutyl, etc.); a carboxyalkyl group, preferably a carboxy lower alkyl containing from 1 to 4 carbon atoms in the alkyl moiety (e.g., β-carboxyethyl, γ-carboxypropyl δ-carboxybutyl, etc.), a sulfatoalkyl group, preferably a sulfato lower alkyl containing from 1 to 4 carbon atoms in the alkyl moiety (e.g., β-sulfatoethyl, γ-sulfatopropyl, δ-sulfatobutyl, etc.); an alkoxyalkyl group, preferably a lower alkoxy lower alkyl containing from 1 to 4 carbon atoms in both the alkoxy and alkyl moieties (e.g., β-methoxyethyl, γ-methoxypropyl, δ-propoxybutyl, etc.); and acyloxyalkyl group, preferably an acyloxy lower alkyl containing from 1 to 4 carbon atoms in the alkyl moiety (e.g., acetoxyethyl, propanoyloxyethyl, butanoyloxybutyl, benzoyloxyethyl, toloyloxypropyl, etc.); an alkoxycarbonylalkyl group, preferably a lower alkoxy carbonyl lower alkyl containing 1 to 4 carbon atoms in both the alkoxy and alkyl moieties (e.g., β-methoxycarbonylethyl, δ-ethoxycarbonylbutyl, β-butoxycarbonylethyl, etc.); a dialkylaminoalkylene group, preferably a di-lower alkylamino lower alkylene containing 1 to 4 carbon atoms in the alkylene and alkyl moieties (e.g., dimethylaminoethylene, diethylaminopropylene, diethylaminobutylene, etc.); a cycloaminoalkylene group, preferably cycloamino lower alkyl containing 4 to 6 atoms in the cycloamino moiety and 1 to 4 atoms in the alkyl moiety (e.g., pyrrolidinylethylene, morpholinopropylene, piperidinobutylene, pyrrolinylmethylene, etc.); (2) an alkenyl group (including a substituted alkenyl group), preferably a lower alkenyl containing 2 to 4 carbon atoms (e.g., ethenyl, allyl, 1-propenyl, 1-butenyl, 2-butenyl, etc.), or (3) an aryl group (including a substituted aryl)—e.g., phenyl, naphthyl, tolyl, xylyl, halophenyl such as p-chlorophenyl, p-bromophenyl, etc., alkoxyphenyl such as methoxyphenyl, 2,4-dichlorophenyl, etc. and an aralkyl group, preferably an aryl lower alkyl containing from 1 to 4 carbon atoms in the alkyl moiety (e.g., benzyl, β-phenethyl, ω-phenbutyl, etc.)

f. Y represents the atoms necessary to complete an aryl (preferably phenyl or naphthyl) ring which is ortho-nitro-substituted and preferably is also para-substituted with a nitro or other electron-withdrawing group such as

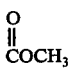

and which can have other substitutents attached to it and other carbocyclic rings fused to it (e.g., 2-nitrophenyl, 2,4-dinitrophenyl, 2,6-dinitrophenyl, 2,4,6-trinitrophenyl, 2-nitronaphthyl, 2,4-dinitronaphthyl, 2-nitro-4-cyanophenyl, 2-nitro-4-ethoxycarbonylphenyl, 2-nitro-4-trifluoro-methylphenyl, and the like); and g. $Z_1$ represents the non-metallic atoms necessary to complete a heterocyclic nucleus of the type used in cyanine dyes containing 5 or 6 atoms in the heterocyclic ring containing the electron-donating atom of the formula which ring can contain a second hetero atom such as oxygen, nitrogen, selenium or sulfur. The heterocyclic nucleus preferably is selected from the group consisting of a thiazole nucleus including substituted and unsubstituted benzothiazole and naphthothiazole nuclei and like, (e.g., thiazole, 4-methylthiazole, 4-phenylthiazole, 4,5-diphenylthiazole, 4-(2-thienyl)thiazole, benzothiazole, 4-chlorobenzothiazole, 4-methylbenzothiazole, 4-methoxybenzothiazole, 4-ethoxybenzothiazole, 4-phenylbenzothiazole, 5-chlorobenzothiazole, 5-bromobenzothiazole, 5-methylbenzothiazole, 5-methoxybenzothiazole, 5-ethoxybenzothiazole, 5-phenylbenzothiazole, 6-chlorobenzothiazole, 6-bromobenzothiazole, 6-methylbenzothiazole, 6-methoxybenzothiazole, 6-ethoxybenzothiazole, 5-methoxynaphtha[2,3-d]thiazole, β-naphthothiazole, α-naphthothiazole, 5-nitrobenzothiazole, 6-nitrobenzothiazole, 5-chloro-6-nitrobenzothiazole, etc.); an oxazole nucleus including substituted and unsubstituted benzoxazole and naphthoxazole nuclei and the like, (e.g., oxazole, 4-phenyloxazole, benzoxazole, 5-chlorobenzoxazole, 5-methylbenzoxazole, 5-bromobenzoxazole, 5-methoxybenzoxazole, 5-ethoxybenzoxazle, 5-phenylbenzoxazole, 5-methoxynaphthoxazole, 5-nitrobenzoxazole, 6-nitrobenzoxazole, 5-chloro-6-nitrobenzoxazole, etc.); a selenazole nucleus including substituted and unsubstituted benzoselenazole and naphthoselenazole nuclei and the like, (e.g., selenazole, 4-methylselenazole, 4-nitroselenazole, 4-phenylselenazole, benzoselenazole, 5-chlorobenzoselenazole, 6-chlorobenzoselenazole, naphtho[2,1-d]selenazole, 5-nitrobenzoselenazole, 6-nitrobenzoselenazole, 5-chloro-6-nitrobenzoselenazole, nitro group-substituted naphthoselenazoles, etc.); a thiazoline nucleus, (e.g., thiazoline, 4-methylthiazoline, 4-nitrothiazoline, etc.); a 2-pyridine nucleus, (e.g., 2-pyridine, 5-methyl-2-pyridine, etc.); a 4-pyridine nucleus, (e.g., 4-pyridine, 3-methyl-4-pyridine, nitro group-substituted pyridines, etc.); a 3,3-dialkylindolenine nucleus (e.g., 3,3-dimethylindolenine, 3,3-diethyl-5 or 6-cyanoindolenine, 3,3-diethyl-5 or 6-nitroindolenine, 3,3-dimethyl-5 or 6-nitroindolenine, etc.); an imidazole nucleus, (e.g., imidazole, 1-alkylimidazole, benzimidazole, 1,3-dialkyl, 1,3-diaryl or 1-alkyl-3-arylimidazoles and benzimidazoles, such as 5-chloro-1,3-dialkylbenzimidazoles, 5-chloro-1,3-diarylbenzimidazoles, 5,6-dichloro-1,3-diarylbenzimidazoles, 5-methoxy-1,3-dialkylbenzimidazoles, 5-methoxy-1,3-diarylbenzimidazoles, 5-cyano-1,3-dialkylbenzimidazoles, 5-cyano-1,3-diarylbenzimidazoles, 1,3-dialkylnaphth[1,2-d]imidazole, 1,3-diarylnaphth[2,1-d]imidazole, etc.); a quinoline nucleus, (e.g., quinoline, 6-methylquinoline, 6-methoxyquinoline, 6-ethoxyquinoline, 6-chloroquinoline, 4-methoxyquinoline, 4-methylquinoline, 8-methoxyquinoline, β-methylquinoline, 4-chloroquinoline, 6-nitroquinoline, etc.); an imidazo[4,5-b]quinoxaline nucleus (as described in Brooker and Van Lare, U.S. Pat. No. 3,431,111), (e.g., imidazo[4,5-b]quinoxaline, 1,3-dialkylimidazo[4,5-b]quinoxaline[such as 1,3-diethylimidazo[4,5-b]quinoxaline], 6-chloro-1,3-diethylimidazo[4,5-b]quinoxaline, etc., 1,3-dialkenylimidazo[4,5-b]quinoxaline such as 1,3-diallylimidazo[4,5-b]-quinoxaline, 6-chloro-1,3-diallylimidazo[4,5-b]quinoxaline, etc., 1,3-diarylimidazo[4,5-b]quinoxaline such as 1,3-diphenylimidazo[4,5-b]quinoxaline, 6-chloro-1,3-diphenylimidazo[4,5-b]quinoxaline, etc.); a 3H-pyrrolo[2,3-b]pyridine nucleus, e.g., 3,3-dialkyl-3H-pyrrolo[2,3-b]pyridine such as 3,3-dimethyl-3H-pyrrolo[2,3-b]pyridine, 3,3-diethyl-3H-pyrrolo[2,3-b]pyridine, 1,3,3-trialkyl-3H-pyrrolo[2,3-b]pyridine such as 1,3,3-triethyl-3H-pyrrolo[2,3-b]pyridine, etc.); and a thiazolo[4,5-b]quinoline nucleus; a pyrylium (including benzopyrylium, thiapyrylium and benzothiapyrylium) nucleus; and a dithiolinium nucleus. In the most preferred embodiment $Z_1$ represents the atoms necessary to form a pyridine or quinoline nucleus.

The above dyes, wherein $k$ represents O, preferably are prepared by reacting a heterocyclic salt of the formula:

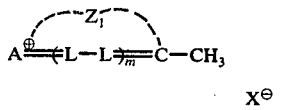

II.

with a nitro-substituted compound having the formula:

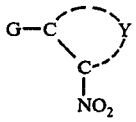

III.

In the above formulae II and III, $m$, $n$, A, $Z_1$, L, and Y have the same meaning as defined above, G represents a halide such as fluoride, chloride or bromide, and X represents an acid anion (e.g., halide such as chloride, bromide, or iodide, p-toluenesulfonate, thiocyanate, sulfamate, perchlorate fluoroborate, methylsulfonate, ethylsulfonate, fluorosulfonate, 2,4-dinitrobenzenesulfonate, etc.).

The preparation of dyes according to the description above is fully set out in Belgian Pat. No. 788,279 published Feb. 28, 1973.

Examples of useful dyes in photothermographic materials according to the invention are 2-(2,4-Dinitrobenzylidene)-3-ethylbenzothiazoline

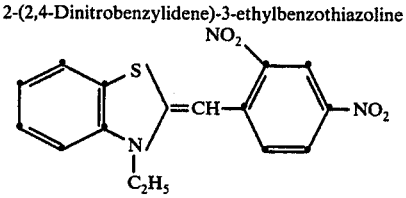

2-(2,4-Dinitrobenzylidene)-1,3-diethyl-1,2-dihydroimidazo-[4,5-b]quinoxaline

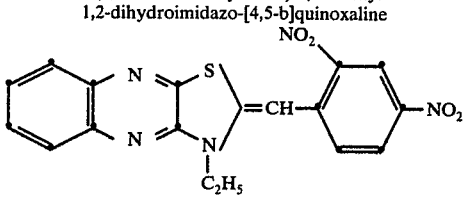

2-(2,4-Dinitrobenzylidene)-3-ethyl-2,3-dihydrothiazolo-[4,5-b]quinoline

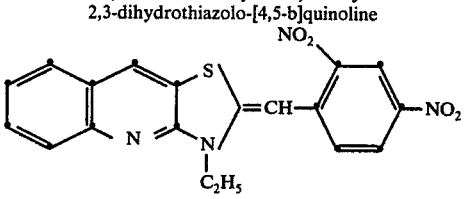

2-(2,4-Dinitrobenzylidene)-1,3,3-trimethylindoline

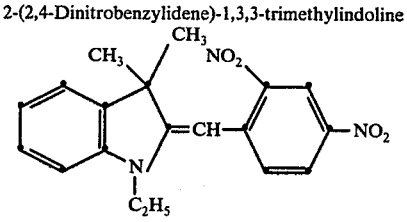

4-(2,4-Dinitrobenzylidene)-1-ethyl-1,4-dihydroquinoline

-continued

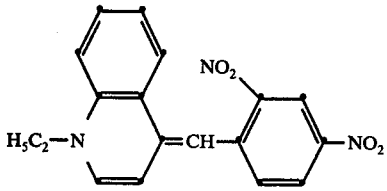

2-(2,4-Dinitrobenzylidene)-1,2-dihydro-1-(3-sulfopropyl)quinoline, sodium salt

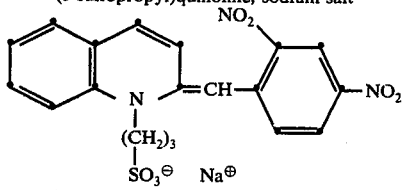

4-(2,4-Dinitrobenzylidene)-1,2-dihydro-1-(4-sulfobutyl)quinoline, sodium salt

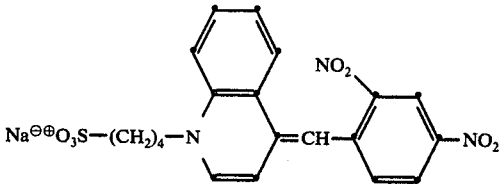

and 1,4-Dihydro-4-(2,4-dinitrobenzylidene)-1-octadecylquinoline

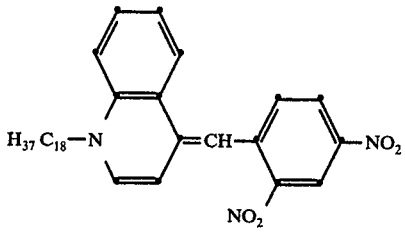

One embodiment of the invention is in a photothermographic element comprising a support having thereon a catalyst, an oxidation-reduction image-forming combination comprising a heavy metal salt oxidizing agent with a reducing agent, and a binder; the improvement comprising the above-mentioned dyes as the catalyst.

The dye is typically present in the photothermographic composition at a concentration range from about $10^{-1}$ mole to about $10^{-5}$ mole of energy-sensitive dye per mole of silver in the silver salt oxidizing agent and preferably at a concentration ranging from about $10^{-2}$ to about $10^{-4}$ mole per mole of silver.

The photothermographic elements and compositions according to the invention comprise an oxidation-reduction image-forming combination which contains an oxidizing agent, preferably a heavy metal salt oxidizing agent. The heavy metal salt oxidizing agent can be a heavy metal salt of an organic acid such as a fatty acid which is resistant to darkening upon illumination. An especially useful class of heavy metal salts of organic acids is represented by the water insoluble silver salts of long-chain fatty acids which are stable to light. Compounds which are suitable silver salt oxidizing agents include silver behenate, silver stearate, silver oleate, silver laurate, silver hydroxystearate, silver caprate, silver myristate and silver palmitate. Silver salts can be employed as the heavy metal salt oxidizing agent which are not silver salts of long chain fatty acids. Such silver salt oxidizing agents which are useful include, for example, silver benzoate, silver benzotriazole, silver terephthalate, silver phthalate and the like.

A range of bis-naphthol reducing agents can be employed in the practice of the invention to provide a desired developed image. These can be employed in combination, if desired, with other reducing agents. Suitable organic reducing agents which can be employed in the described combination include, for example, substituted phenols and naphthols.

The bis-naphthol which is preferred is a bis-$\beta$-naphthol of the formula:

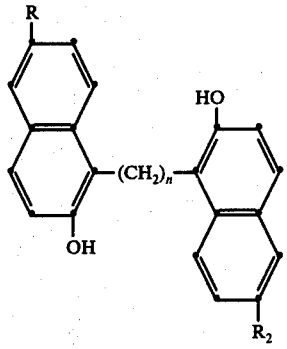

wherein R and/or $R_2$ is hydrogen, alkyl with 1 to 3 carbon atoms, alkoxy, e.g. alkoxy containing 1 to 2 carbon atoms, such as methoxy or ethoxy; halogen, nitro, amino, or a diazonium halide salt and $n$ is 0 or 1.

An especially suitable bis-$\beta$-naphthol is 1,1'-bi-2-naphthol of the formula:

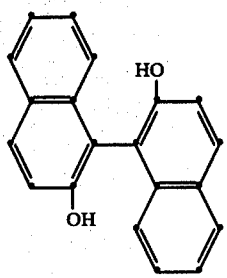

Other examples of suitable bis-$\beta$-naphthols which can be employed in the practice of the invention include:

6,6'-dibromo-2,2'-dihydroxy-1,1'-binaphthyl
6,6'-dinitro-2,2'-dihydroxy-1,1'-binaphthyl
bis-(2-hydroxy-1-methane).

The described reducing agents are suitable in a range of concentration; however, they are especially suitable, at a concentration from about 0.1 to 0.75 mole of reducing agent per mole of silver in the silver salt oxidizing agent in an element as described.

Other reducing agents can be used alone or in conjunction with the above bis-naphthol reducing agents. These include, for example, polyhydroxybenzenes such as hydroquinone developing agents, e.g., hydroquinone, alkyl-substituted hydroquinones as exemplified by tertiary butylhydroquinone, methylhydroquinone, 2,5-dimethylhydroquinone and 2,6-dimethylhydroquinone; catechols and pyrogallol; halo-substituted hydroquinones such as chlorohydroquinone or dichlorohydroquinone; alkoxy-substituted hydroquinones such as methoxyhydroquinone or ethoxyhydroquinone; methoxynaphthalene; phenylenediamine developing agents; methylgallate; aminophenol developing agents, such as 2,4-diaminophenols and methylaminophenols; ascorbic acid developing agents such as ascorbic acid, ascorbic acid ketals and ascorbic acid derivatives such as those described in U.S. Pat. No. 3,337,342 of Green issued Aug. 22, 1967; hydroxylamine developing agents such as N,N'-di(2-ethoxyethyl)hydroxylamine; 3-pyrazolidone developing agents such as 1-phenyl-3-pyrazolidone and 4-methyl-4-hydroxymethyl-1-phenyl-3-pyrazolidone including those described in British patent specification No. 930,572 published July 3, 1963; hydroxytetronic acid, and hydroxytetronimide developing agents; reductone developing agents such as anhydrodihydropyrrolidino hexose reductone; and the like. Particularly preferred reducing agents comprise sulfonamidophenols and sulfonamidonaphthols such as described in U.S. Pat. No. 3,801,321 issued Apr. 2, 1974 to Evans and McLaen.

The photothermographic element and composition can contain various colloids alone or in combination as binders. Suitable materials are typically hydrophobic but hydrophilic materials can also be employed. They are transparent or translucent and include both naturally-occurring substances such as proteins, for example, gelatin, gelatin derivatives, cellulose derivatives, polysaccharides such as dextran, gum arabic and the like; and synthetic polymeric substances such as water-soluble polyvinyl compounds like poly(vinyl pyrrolidone), acrylamide polymers and the like. Other synthetic polymeric compounds which can be employed include dispersed vinyl compounds such as in latex form and particularly those which increase dimensional stability of photographic materials. Suitable synthetic polymers include those described in U.S. Pat. No. 3,142,568 of Nottorf issued July 28, 1964; U.S. Pat. No. 3,193,386 of White issued July 6, 1955; U.S. Pat. No. 3,062,674 of Houck et al issued Nov. 6, 1962; U.S. Pat. No. 3,220,844 of Houck et al issued Nov. 30, 1965; U.S. Pat. No. 3,286,289 of Ream et al issued Nov. 22, 1966 and U.S. Pat. No. 3,411,911 of Dykstra issued Nov. 19, 1968. Effective polymers include water insoluble polymers of alkyl acrylates and methacrylates, acrylic acid, sulfoalkyl acrylates or methacrylates, and those which have crosslinking sites which facilitate hardening or curing as well as those having recurring sulfobetaine units as described in Canadian Pat. No. 774,054. Preferred high molecular weight materials and resins include poly(vinyl butyral), cellulose acetate butyrate, polymethyl methacrylate, poly(vinyl pyrrolidone), ethyl cellulose, polystyrene, polyvinyl chloride, chlorinated rubber, polyisobutylene, butadiene-styrene copolymers, vinyl chloride-vinyl acetate copolymers, copolymers of vinyl acetate, vinyl chloride and maleic acid, polyvinyl alcohol, and high molecular weight ethylene oxide polymers.

It is often desirable to employ a so-called activator toning agent, also known as an accelerator-toning agent, in the photothermographic elements according to the invention to obtain a desired image. The activator toning agent is typically useful in a range of concentration, such as a concentration of about 0.10 moles to about 1.1 moles of activator toning agent per mole of oxidizing agent in the photothermographic element. A typical suitable activator toning agent is a heterocyclic activator toning agent containing at least one nitrogen atom as described in Belgian Pat. No. 766,590 issued June 15, 1971. Typical activator toning agents include, for example, cyclic imides, such as phthalimide, N-hydroxyphthalimide, N-hydroxy-1,8-naphthalimide, N-potassium phthalimide, N-mercury phthalimide, succinimide and/or N-hydroxysuccinimide. Other activator toning agents which can be employed include 1-(2H)-phthalazinone, 2-acetylphthalazinone and the like.

It is desirable, in some cases, to employ an image stabilizer and/or image stabilizer precursor in the described elements of the invention. Typical image stabilizers or stabilizer precursors are described, for example, in Belgian Pat. No. 768,071 issued Jul. 30, 1971, and Hiller U.S. Pat. No. 3,839,041 issued Oct. 1, 1974. Typical stabilizer precursors include, for example, azothioethers and blocked azoline thione stabilizer precursors, thiazoles, and polybrominated organic compounds.

An especially useful photothermographic element according to the invention comprises a support having thereon (a) an oxidation-reduction image-forming combination comprising (i) 1,1'-bi-2-naphthol and (ii) silver behenate, (b) a polyvinyl butyral binder, (c) phthalimide, and (d) 4-(2,4-dinitrobenzylidene)-1-ethyl-1,4-dihydroquinoline.

Photothermographic elements according to the invention can contain development modifiers that function as speed-increasing compounds, hardeners, antistatic layers, plasticizers and lubricants, coating aids, brighteners, spectral sensitizing dyes, absorbing and filter dyes, also as described in the *Product Licensing Index,* Vol. 92, Dec. 1971, publication 9232, pages 107–110, paragraph I as well as incorporated developers such as described in U.S. Pat. No. 3,672,904 issued Jun. 27, 1972 and antihalation dyes such as described in Belgian Pat. No. 732,683 issued Oct. 16, 1969.

The photothermographic elements according to the invention can comprise a wide variety of supports. Typical supports include cellulose nitrate film, cellulose ester film, poly(vinyl acetal) film, polystyrene film, poly(ethylene terephthalate) film, polycarbonate film and related films or resinous materials, as well as glass, paper, metal and the like supports which can withstand the processing temperatures employed according to the invention. Typically a flexible support is employed.

Another embodiment of the invention is a photothermographic composition comprising (a) an oxidation-reduction image-forming combination comprising (i) a silver salt oxidizing agent with (ii) a bis-beta-naphthol reducing agent; (b) a binder, as described, such as poly(vinyl butyral); and (c) an energy-sensitive dye which upon exposure to actinic radiation catalyzes the reduction of the silver compound to metallic silver and which requires an exposure time of less 1 minute to each a silver density of at least 2.0 when subjected to the tests as described above.

The photothermographic composition and other compositions according to the invention can be coated on a suitable support by various coating procedures including dip coating, air knife coating, curtain coating or extrusion coating using hoppers such as described in U.S. Pat. No. 2,681,294 of Belgium issued Jun. 15, 1954. If desired, two or more layers can be coated simultaneously such as described in U.S. Pat. No. 2,761,791 of Russell issued Sept. 4, 1956 and British patent specification No. 837,095.

Ultraviolet-absorbing dyes can be used in the described photothermographic elements and compositions of the invention to confer additional sensitivity to the elements and compositions. Useful ultraviolet-absorbing dyes are described, for example, in *Product Licensing Index,* Vol. 92, Dec. 1971, publication 9232, pp. 107–110. Useful ultraviolet-absorbing dyes are present in the photothermographic element or composition in coverages ranging from about 0.1 mg./929 cm.$^2$ to about 20.0 mg./929 cm.$^2$.

After exposure of the described photothermographic element according to the invention, typically to visible light, the resulting latent image can be developed merely by overall heating the element to moderately elevated temperatures. This merely involves heating the described photothermographic element overall from about 80° C to about 250° C such as for about 0.5 seconds to about 60 seconds. By increasing or decreasing the length of time of heating, a higher or lower temperature within the described range can be employed depending upon the desired image. A developed image is typically produced within several seconds, such as about 0.5 seconds to about 60 seconds. A processing temperature of about 110° C to about 165° C is especially useful.

Any suitable means can be used for providing the desired processing temperature range. The heating means can be a simple hot plate, iron, roller or the like.

Processing is usually carried out under ambient conditions of pressure and humidity. Conditions outside normal atmospheric pressures and humidity can be employed, if desired.

If desired, the photothermographic element of this invention can be simultaneously exposed and heat processed to development.

For the purposes of the present invention the energy-sensitive dye must be present in the photothermographic composition itself. The addition of the energy-sensitive dye to an adjacent layer to the layer containing the photothermographic composition will not yield the excellent speed of the element described herein.

The following examples are included for a further understanding of the invention.

EXAMPLE 1

A series of coatings with and without the nitrobenzylidene reducing agent precursors were exposed and processed in a physical developer as follows:

A coating composition was prepared by mixing the following components at 40° C and coating at 0.0006 inch:

| | |
|---|---|
| Aqueous solution containing 5.6% by weight of gelatin of pH 10.0 | 18.0 ml |
| Aqueous solution containing 20% by weight copoly(n-butyl acrylate/3 acryloyloxypropane-1-sulfonic acid sodium salt/2-acetoacetoxyethyl methacrylate) | 1.0 ml |
| Aqueous solution containing 3.5% by weight silver nitrate | 0.6 ml |
| Acetone | 1.0 ml |

The above composition served as a control. The following coatings, Examples 1A, 1B, 1C and 1D were prepared by adding to the above control coating at $1 \times 10^{-4}$ mole/m$^2$ of support of the following nitrobenzylidene reducing agent precursors:

| | |
|---|---|
| 2-(2,4-dinitrobenzylidene)-3-ethylbenzothiazoline | 1A |

-continued

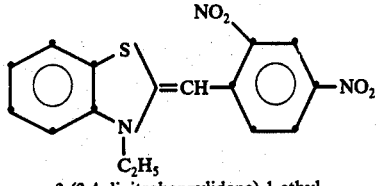

2-(2,4-dinitrobenzylidene)-1-ethyl-1,2-dihydroquinoline 1B

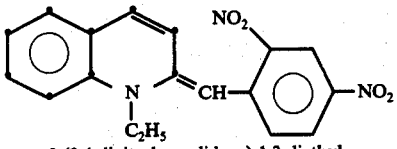

2-(2,4-dinitrobenzylidene)-1,3-diethyl-1,2-dihydroimadazo[4,5-b]quinoxaline 1C

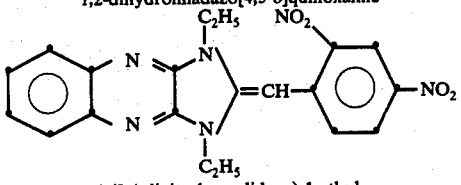

4-(2,4-dinitrobenzylidene)-1-ethyl-1,4-dihydroquinoline 1D

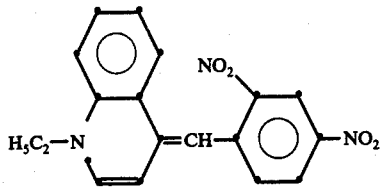

Samples from each coating were exposed through a graduated density step tablet to four flashes from an Ascor light no. 444 (Wratten 2B filter) at a distance of 25 cm. and processed for 1 minute and 3 minutes in 50 ml. of a physical developer containing 1 ml of a 1% alkaline solution of 5-methylbenzotriazole. The developer bath was prepared by combining equal volumes of parts A and B below.

| | |
|---|---|
| Part A | |
| Distilled water | 800 ml |
| Anhydrous sodium sulfite | 20 g |
| Sodium isoascorbate | 20 g |
| Sodium carbonate monohydrate | 50 g |
| Aqueous solution containing 1% by weight hydrazine | 20 ml |
| Distilled water to total volume | 1000 ml |
| Part B | |
| Distilled water | 800 ml |
| Sodium thiosulfate pentahydrate | 30 g |
| *Silver chloride | $5 \times 10^{-2}$ moles |
| Distilled water to total volume | 1000 ml |

*Silver chloride preparation:
solution
(1) dissolve 42.4 g $AgNO_3$ in 900 ml distilled water
(2) dissolve 42.4 g KCl in 900 ml distilled water
add 180 ml of (1) to 180 ml of (2), let stand overnight and decant off supernatant liquid The following sensitometric results were obtained in Table I:

TABLE I

| Example | Reducing Agent Precursor | Visible Steps 1 min. Dev. | Visible Steps 3 min. Dev. |
|---|---|---|---|
| Control | none | none | 4 |
| 1A | A | 6 | 8 |
| 1B | B | 5 | 6 |
| 1C | C | 10 | fog |
| 1D | D | 12 | 14 |

This process is further illustrated by adding to the above coating composition control at $1 \times 10^{-4}$ mole/m$^2$ of support of the reducing agent precursor 4-(2,4-dinitrobenzylidene)-1-methyl-1,4-dihydroquinoline and exposing as above and processing an aqueous cupric acetate solution [$Cu(OAc)_2 \cdot H_2O$, 10 g/250 ml]. A copper image resulted.

EXAMPLE 2

A dispersion was prepared by ball-milling the following composition for 18 hours.

| Dispersion A | |
|---|---|
| silver behenate | 168 gms. |
| poly(vinyl butyral) | 120 gms. |
| acetone-toluene (1:1 parts by volume) | 1600 ml |

A photothermographic element was prepared by coating the following composition on a suitable paper support at a wet thickness of 0.004 inch.

| | |
|---|---|
| Silver behenate Dispersion A | 56.0 ml |
| 1,1'-Bi-2-naphthol (6.3% by weight in acetone) | 21.0 ml |
| Phthalimide (5.0% by weight in acetone) | 19.0 ml |
| Polyethylene glycol[1] (1.0% by weight in acetone) | 25.0 ml |
| Poly(vinyl butyral) (3.0% by weight in acetone) | 30.0 ml |
| 4-(2,4-Dinitrobenzylidene)-1-ethyl-1,4-dihydroquinoline (1 mg per ml acetone) | 30.0 ml |

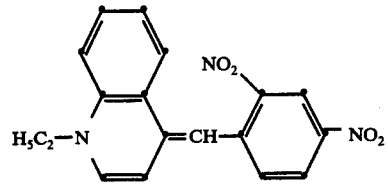

[1]Polyethylene glycol derivative of oleyl alcohol

The photothermographic element was imagewise exposed through a conventional step wedge to a Xenon arc high intensity flash for $10^{-3}$ seconds and heat processed for about 15 seconds on a curved hot block at a temperature of about 126° C. The resulting photographic image was jet black and comprised nine visible steps.

EXAMPLE 3

A dispersion was prepared by ball-milling the following composition for 18 hours:

| Dispersion A | |
|---|---|
| silver behenate | 68 gms. |
| poly(vinyl butyral) | 120 gms. |
| acetone-toluene (1:1 parts by volume) | 1600 ml. |

A photothermographic element was prepared by coating the following composition on a photographic paper support at a wet thickness of 0.004 inch.

| | |
|---|---|
| silver behenate Dispersion A | 4.6 ml |
| 1,1'-bi-2-naphthol (6.3% by weight in acetone) | 1.7 ml |
| phthalimide (5.0% by weight in acetone) | 1.5 ml |
| polyethylene glycol (10 mg/ml acetone) | 2.2 ml |
| polyvinyl butyral (3.0% by weight in acetone) | 10.0 ml |
| 2-(2,4-Dinitrobenzylidene)-3-ethylbenzothiazoline (1.0 mg per ml acetone) | 5.0 ml |

-continued

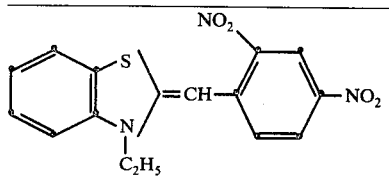

The photothermographic element was imagewise exposed to a Xenon arc high intensity flash for $10^{-3}$ seconds and heat processed for about 15 seconds on a curved hot block at a temperature of about 127° C. The resulting image was brown on a tan background.

EXAMPLE 4

A photothermographic element was prepared by coating the following composition on a photographic support at a wet thickness of 0.004 inch.

| | |
|---|---|
| Silver behenate dispersion A (as described in Example 2) | 9.3 ml |
| 1,1'-bi-2-naphthol (6.3% by weight in acetone) | 3.5 ml |
| phthalimide (5.0% by weight in acetone) | 3.1 ml |
| polyethylene glycol (1.0% by weight in acetone) | 4.1 ml |
| 2-(2,4-dinitrobenzylidene)-1,3-diethyl-1,2-dihydroimidazo-[4,5-b]quinoxaline (1 mg/ml acetone) | 2.0 ml |

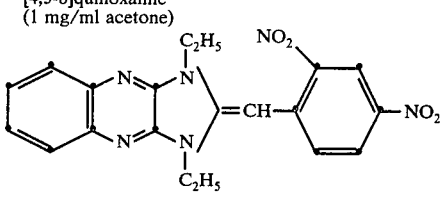

The photothermographic element was imagewise exposed through a conventional step wedge to the high intensity light source described in Example 1 for $10^{-3}$ seconds and heat processed for 25 seconds on a curved hot block at a temperature of 130° C. A faint gray image comprising seven visible steps resulted.

EXAMPLE 5

The procedure described in Example 4 was repeated with the exception that the photothermographic composition contained 2 ml of a solution (1 mg/ml acetone) of 2-(2,4-dinitrobenzylidene)-3-ethyl-2,3-dihydrothiazolo[4,5-b]quinoline

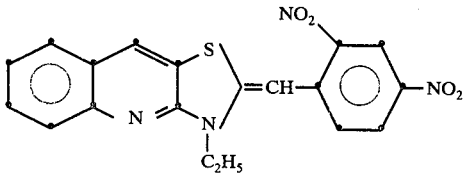

substituted for the dye of Example 4.

The photothermographic element was imagewise exposed through a conventional step wedge to a high intensity light source as described in Example 2 for $10^{-3}$ seconds and heat processed for 30 seconds on a curved hot block at a temperature of 130° C. A dark gray image comprising six visible steps resulted.

EXAMPLE 6

The procedure set out in Example 4 was repeated with the exception that the photothermographic element contained 2 ml of the solution (1 mg/ml acetone) of 2-(2,4-dinitrobenzylidene)-1,3,3-trimethylindoline

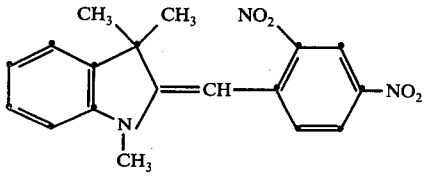

substituted for the dye of Example 4

The photothermographic element was imagewise exposed to a high intensity light source as described in Example 2 for $10^{-3}$ seconds and heat processed for 25 seconds on a curved hot block at a temperature of 130° C. A black image comprising seven visible steps resulted.

EXAMPLE 7

The procedure set out in Example 2 was repeated with the exception that 1,4-dihydro-4-(2,4-dinitrobenzylidene)-1-octadecylquinoline

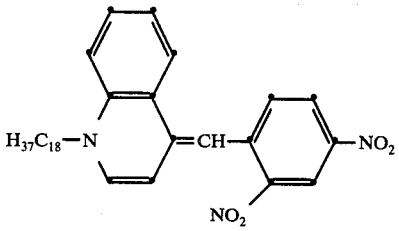

was substituted for the dye of Example 2.

The photothermographic element was imagewise exposed to the high intensity light source described in Example 2 for $10^{-3}$ seconds. The exposed sample was heat processed for 18 seconds on a curved hot block at a temperature of 126° C. A black image comprising nine visible steps resulted.

EXAMPLES 8–13

These examples illustrate the increased speed attained when an ultraviolet-absorbing dye is added to the photothermographic element.

A series of photothermographic elements were prepared by adding 10 ml of a dispersion comprising the following composition:

| Dispersion C | |
|---|---|
| Silver behenate Dispersion A (as described in Example 2) | 23.2 ml |
| 1,1'-Bi-2-naphthol (6.3% by weight in acetone) | 8.7 ml |
| Phthalimide (5.0% by weight in acetone) | 7.9 ml |
| Polyethylene glycol (1.0% by weight in acetone) | 10.2 ml |
| Polyvinyl butyral (3.0% by weight in acetone) | 50.0 ml |
| 4-(2,4-Dinitrobenzylidene)-1-ethyl-1,4-dihydroquinoline (1.0 mg/ml acetone) | |

-continued

Dispersion C

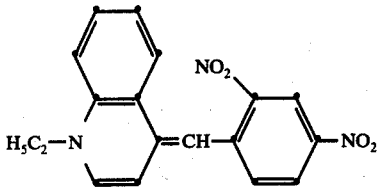

to 10 ml of a solution (1 mg/ml acetone) of various ultraviolet-absorbing dyes. The mixtures were coated on photographic support paper at a wet thickness of 0.004 inch.

The elements were imagewise exposed to a high intensity light source as described. in Example 2 for $10^{-3}$ seconds and heat processed for 15 seconds on a curved hot block at a temperature of about 127° C and the speed of the elements was compared to the speed of the same element without ultraviolet absorbing dyes added. The relative speeds were measured at 0.30 above $D_{min}$.

The results are shown in Table I below.

Table I

| Example | Ultraviolet-Absorbing Dye | Relative Speed | Visible Steps |
|---|---|---|---|
| Control | — | 100 | 9 |
| 8 | A[1] | 110 | 9 |
| 9 | B[2] | 174 | 9 |
| 10 | C[3] | 159 | 9 |
| 11 | D[4] | 135 | 9 |
| 12 | E[5] | 138 | 9 |
| 13 | F[6] | 110 | 9 |

A[1] 2-(3-Cyano-3-dodecylsulfonylallylidene)-3-(3-sulfopropyl)-thiazolidine potassium salt

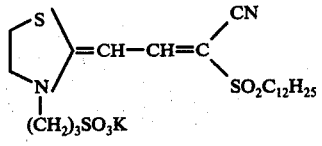

B[2] 2-(3-Cyano-3-dodecylsulfonylallylidene)-3-ethylthiazolidine.

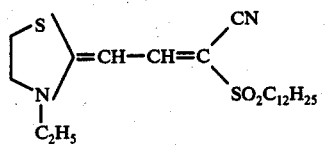

C[3] 2-(3-Cyano-3-dodecylsulfonylallylidene)-3-methylthiazolidine

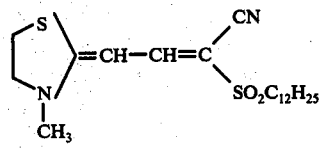

D[4] 2-(3-Cyano-3-dodecylsulfonylallylidene)-3-(2-carboxyethyl)-thiazolidine

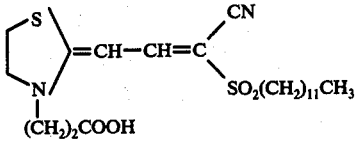

E[5] 2-[3-Cyano-3-(4-t-butylphenylsulfonyl)allylidene]-3-(3-sulfopropyl)thiazolidine, sodium salt Table I-continued

| Example | Ultraviolet-Absorbing Dye | Relative Speed | Visible Steps |
|---|---|---|---|
| F[6] | 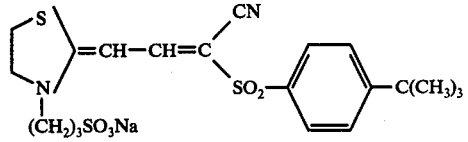 | | |

F[6] 2-[3-(10-Carboxydecylsulfonyl-3-cyanoallylidene]-3-(3-sulfopropyl)thiazolidine, disodium salt

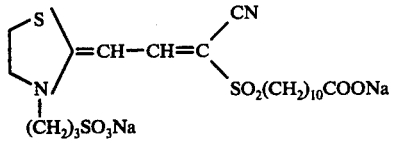

EXAMPLE 14

A photothermographic element according to this invention was compared to the same element with the addition of behenic acid as described, for example, without the dyes of this invention, in U.S. Pat. No. 3,409,438 as follows.

Dispersion D was prepared by ball milling the following composition for 18 hours.

| | |
|---|---|
| Silver behenate | 168 gm |
| Poly(vinyl butyral) | 120 gm |
| Acetone-tuluene (1:1 parts by volume) | 1600 ml |

A photothermographic element was prepared by coating the following composition on a photographic paper support at a wet thickness of 0.004 inch.

| | |
|---|---|
| Silver behenate Dispersion D | 56.0 gm |
| 1,1'-Bi-2-naphthol (6.3% by weight in acetone) | 21.0 ml |
| Phthalimide (5.0% by weight in acetone) | 19.0 gm |
| Polyethylene glycol (1.0% by weight in acetone) | 25.0 gm |
| 4-(2,4-Dinitrobenzylidene)-1-ethyl-1,4-dihydroquinoline (1.0 mg/ml in acetone) | 30.0 ml |

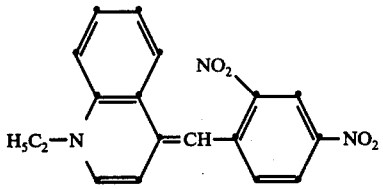

The photothermographic element was imagewise exposed to a high intensity Xenon arc flash for $10^{-3}$ seconds and heat processed for about 15 seconds in a curved hot block at a temperature of 126° C. The resulting element showed an image comprising eight visible steps.

The above was compared to the same element with the exception that 128 gm of behenic acid were added to dispersion D and processed in the same manner as above. The element containing behenic acid in the absence of the described dihydroquinoline component did not produce an image and showed a highly fogged background.

EXAMPLES 15–24

A series of photothermographic elements was prepared by coating the following compositions containing various dyes at various concentrations on a photographic paper support at a wet thickness of 0.004 inch and imagewise exposing to a high intensity Xenon arc flash for $10^{-3}$ seconds and heat processing the exposed element on a curved hot block for 15–30 seconds at a temperature of 120° C.

| | |
|---|---|
| Silver behenate dispersion[1] | 11.2 ml |
| 1,1'-bi-2-naphthol (6.3% by weight in acetone) | 4.2 ml |
| phthalimide (5.0% by weight in acetone) | 4.2 ml |
| acetone to a total volume of | 140.0 ml |

[1]silver behenate dispersion prepared as described in Example 2.

The following table II shows the results obtained.

Table II

| Example | Dye[1] | Concentration of Dye (mg/140 ml) | Visible Steps |
|---|---|---|---|
| 15 | 7 | 30 | 6 |
| 16 | 8 | 34 | 4 |
| 17 | 9 | 34 | 5 |
| 18 | 10 | 32 | 6 |
| 19 | 11 | 33 | 7 |
| 20 | 12 | 33 | 5 |
| 21 | 13 | 40 | 7 |
| 22 | 14 | 35 | 7 |
| 23 | 15 | 34 | 7 |
| 24 | 16 | 30 | 4 |

[1]The dyes are described on the following page.

4-(2,4-Dinitrobenzylidene)-1,4-dihydro-1-methylquinoline

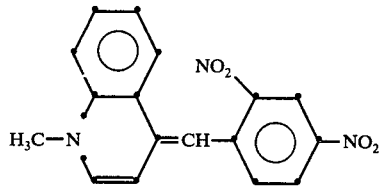

4-(2,4-Dinitrobenzylidene)-1-ethyl-1,4-dihydro-6-nitroquinoline

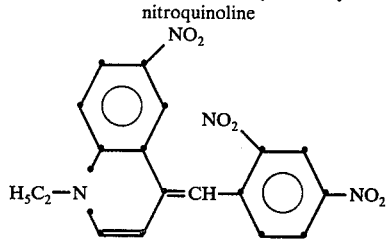

4-(2,4-Dinitro-1-naphthylmethylene)-1-ethyl-1,4-dihydroquinoline

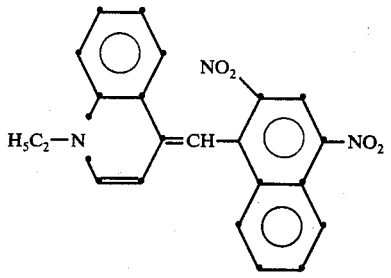

6-Cyano-4-(2,4-dinitrobenzylidene)-1-ethyl-1,4-dihydroquinoline

-continued

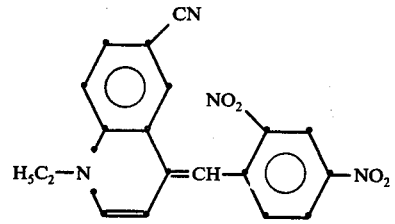

6-Chloro-4-(2,4-dinitrobenzylidene)-1-ethyl-1,4-dihydroquinoline

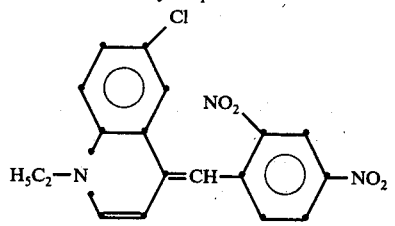

4-(2,4-Dinitrobenzylidene)-1-ethyl-1,4-dihydro-6-methoxyquinoline

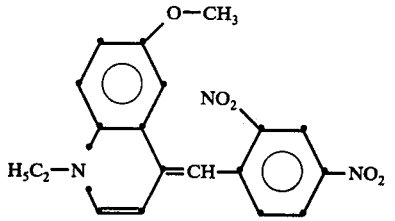

6-Benzoyl-4-(2,4-dinitrobenzylidene)-1-ethyl-1,4-dihydroquinoline

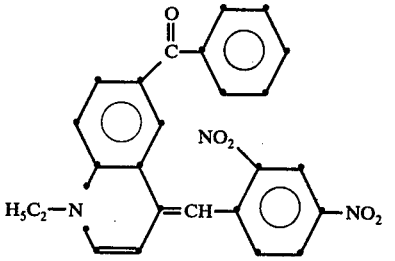

4-(2,4-Dinitrobenzylidene)-6-ethoxycarbonyl-1-ethyl-1,4-dihydroquinoline

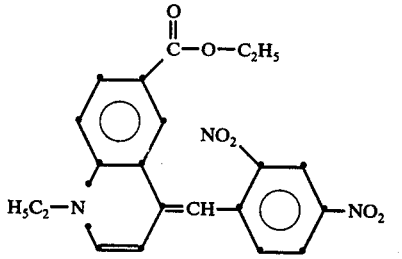

6-Acetyl-4-(2,4-dinitrobenzylidene)-1-ethyl-1,4-dihydroquinoline

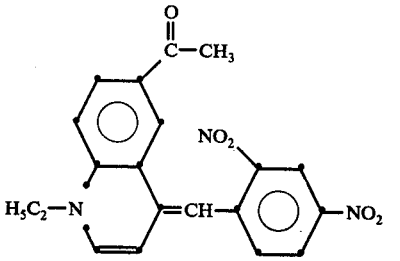

1-(2,4-Dinitrobenzylidene)-1,2-dihydro-2-methylisoquinoline

-continued

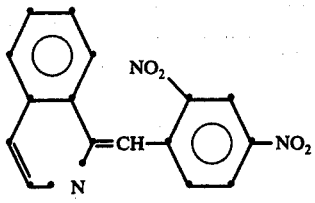

EXAMPLES 25-28

Photothermographic elements containing dyes as described in the present invention are compared to photothermographic elements containing dyes as described in U.S. Pat. No. 3,409,438 as follows.

Three solutions were prepared as follows:

| | |
|---|---|
| Solution 1 | |
| Silver pivalate | 208 mg |
| Xylene | 50 ml |
| Solution 2 | |
| 1,1'-bi-2-naphthol | 286 mg |

-continued

| | |
|---|---|
| Poly(vinyl butyral) | 200 mg |
| Phthalimide | 73.6 mg |
| Xylene | 50 ml |
| Solution 3 | |
| $1.0 \times 10^{-3}$ molar xylene solution of the compound to be tested (kept in dark) | |

Solutions 1 and 2 are combined in a test tube which has been wrapped with foil to exclude room light. Solution 3 is placed in a 1 mm quartz spectrophotometric cell (0.350 ml) and irradiated for a designated time period with a 75 watt bulb fitted with a U.V. cutoff filter. After irradiation, Solution 3 (50 mμ) is added to the combined mixture of Solutions 1 and 2; and the resulting solution is heated in the dark for 10 minutes at 60° C. The reaction mixture is then cooled in an ice-methanol bath.

A control is treated by adding 50 mμ of the non-irradiated solution to combined Solutions 1 and 2. This mixture was heated as described above. A spectrum of the solution is then run to determine silver density.

Time required to reach a density of at least 2.0 for each compound tested in shown in Table III.

Table III

| Example | Compound Tested | | Exposure Time |
|---|---|---|---|
| 25 | 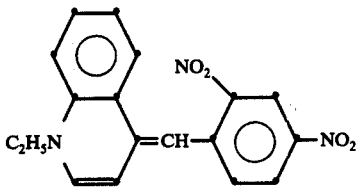 | 4-(2,4-dinitrobenzylidene)-1-ethyl-1,4-dihydroquinoline | 2–4 sec. |
| 26 | 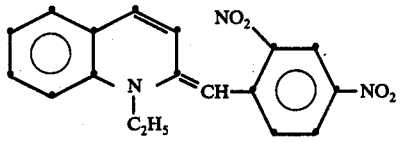 | 2-(2,4-dinitrobenzylidene)-1-ethyl-1,2-dihydroquinoline | 15–30 sec. |
| 27 | 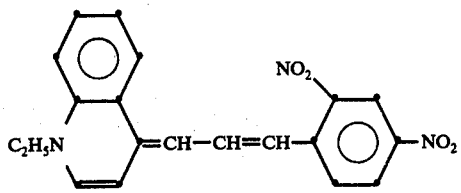 | 1-ethyl-4-[γ-(2,4-dinitro-1-phenyl)allylidene]-1,4-dihydroxyquinoline | 15–30 sec. |
| 28 | 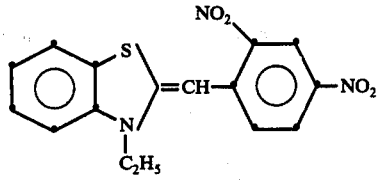 | 2-(2,4-dinitrobenzylidene)-3-ethylbenzothiazoline | 15–30 sec. |
| Control A | 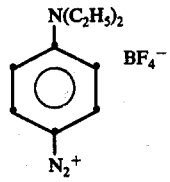 | p-diethylaminobenzene-diazonium fluoroborate | 1–2 min. |

Table III-continued

| Example | Compound Tested | | Exposure Time |
|---|---|---|---|
| Control B | 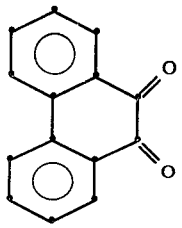 | phenanthrenequinone | 1–2 min. |
| Control C | 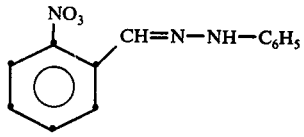 | o-nitrobenzaldehyde phenylhydrazone | 4–8 min. |
| Control D | 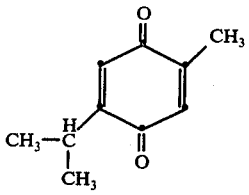 | 2-methyl-5-isopropyl-1,4-benzoquinone | 10–20 min. |
| ,Control E | 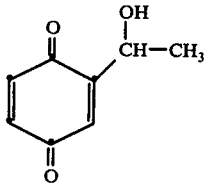 | 2-(α-hydroxyethyl)-1,4-benzoquinone | no reduction after 24 min. |
| Control F | 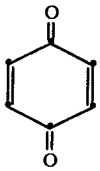 | p-benzoquinone | no reduction after 16 min. |
| Control G | 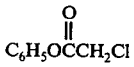 | phenylchloroacetate | no reduction after 16 min. |
| Control H | 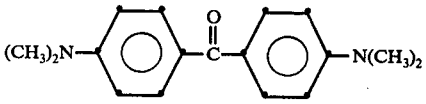 | 4,4'-bis(dimethylamino)-benzophenone | no reduction after 16 min. |
| Control I | 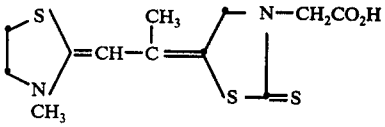 | 3-carboxymethyl-5-[(3-methyl-2(3)-thiazolenylidene)isopropylidene rhodanine | no nreduction after 16 min. |
| Control J | 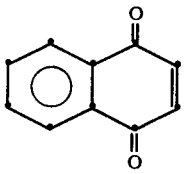 | 1,4-naphthoquinone | no reduction after 16 min. |
| Control K | 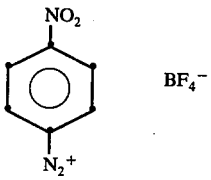 | p-nitrobenzene-diazonium fluoroborate | no reduction after 16 min. |

Table III-continued

| Example | Compound Tested | Exposure Time |
|---|---|---|
| Control L | 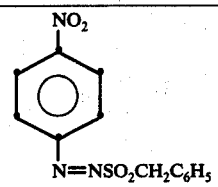 p-nitrophenylmethylsulfonyl diimide | no reduction after 16 min. |
| Control M | 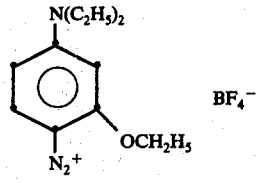 4-(dimethylamino)-2-ethoxy-benzenediazonium fluoroborate | no reduction after 16 min. |
| Control N | 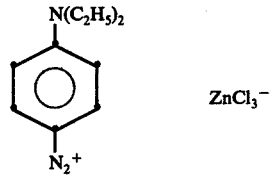 p-(diethylamino)-benzene-diazonium trichlorozincate | no reduction after 16 min. |
| Control O | 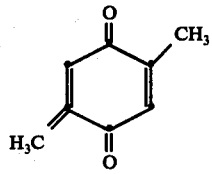 2,5-dimethyl-1,4-benzo-quinone | no reduction after 16 min. |

The invention has been described in detail with particular reference to certain preferred embodiments thereof, but it will be understood that variations and modifications can be effected within the spirit and scope of the invention.

We claim:

1. A non-silver halide, photographic element comprising a support having thereon a layer comprising:
   (a) a silver salt of an organic acid or nitric acid oxidizing agent,
   (b) a binder, and
   (c) an energy sensitive dye represented by the following formula:

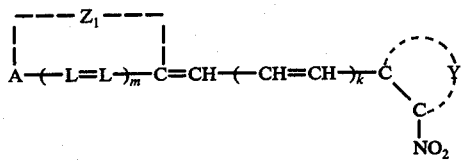

wherein:
   (a) $k$ represents 0 or 1;
   (b) $m$ represents 0 or 1;
   (c) each L represents a methine group;
   (d) A represents oxygen, sulfur or N—$R_1$;
   (e) $R_1$ represents an alkyl group, an alkenyl group or an aryl group;
   (f) $Z_1$ represents the nonmetallic atoms necessary to complete a basic, cyanine dye type heterocyclic nucleus forming a 5- or 6-membered heterocyclic ring whose skeletal atoms consist of the oxygen, sulfur or nitrogen atom of A, carbon atoms and one other atom chosen from the group consisting of carbon, oxygen, nitrogen, selenium and sulfur atoms, and
   (g) Y represents the atoms necessary to complete a nitro-substituted phenyl or naphthyl group.

2. The non-silver halide, photographic element of claim 1 wherein $Z_1$ represents the atoms necessary to complete a pyridine or quinoline nucleus.

3. The non-silver halide, photographic element of claim 1 wherein the silver salt oxidizing agent is silver nitrate.

4. The non-silver halide, photographic element of claim 1 wherein the energy sensitive dye consists essentially of a 4-(2,4-dinitrobenzylidene)-1-ethyl-1,4-dihydroquinoline dye.

5. The non-silver halide, photographic element of claim 1 wherein the energy sensitive dye consists essentially of a 2-(2,4-dinitrobenzylidene)-1,3-diethyl-1,2-dihydroimidazo[4,5-b]quinoxaline dye.

6. A non-silver halide, photographic element comprising a support having thereon a layer comprising:
   (a) silver nitrate,
   (b) a gelatino binder, and
   (c) an energy sensitive dye consisting essentially of a 4-(2,4-dinitrobenzylidene)-1-ethyl-1,4-dihydroquinoline dye.

7. A non-silver halide, photographic composition comprising:
   (a) a silver salt of an organic acid or nitric acid oxidizing agent,
   (b) a binder, and
   (c) an energy sensitive dye represented by the following formula:

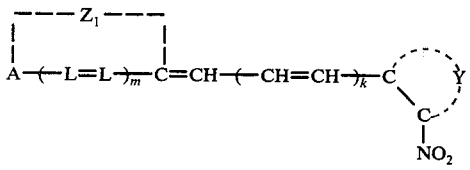

wherein:

(a) $k$ represents 0 or 1;

(b) $m$ represents 0 or 1;

(c) each L represents a methine group;

(d) A represents oxygen, sulfur or N—$R_1$;

(e) $R_1$ represents an alkyl group, an alkenyl group or an aryl group;

(f) $Z_1$ represents the nonmetallic atoms necessary to complete a basic, cyanine dye type heterocyclic nucleus forming a 5- or 6-membered heterocyclic ring whose skeletal atoms consist of the oxygen, sulfur or nitrogen atom of A, carbon atoms and one other atom chosen from the group consisting of carbon, oxygen, nitrogen, selenium and sulfur atoms, and (g) Y represents the atoms necessary to complete a nitro-substituted phenyl or naphthyl group.

8. The non-silver halide, photographic composition of claim 7 wherein $Z_1$ represents the atoms necessary to complete a pyridine or quinoline nucleus.

9. The non-silver halide, photographic composition of claim 7 wherein the silver salt oxidizing agent is silver nitrate.

10. The non-silver halide, photographic composition of claim 7 wherein the energy sensitive dye consists essentially of a 4-(2,4-dinitrobenzylidene)-1-ethyl-1,4-dihydroquinoline dye.

11. The non-silver halide, photographic composition of claim 7 wherein the energy sensitive dye consists essentially of a 2-(2,4-dinitrobenzylidene)-1,3-diethyl-1,2-dihydroimidazo[4,5-b]quinoxaline dye.

12. A non-silver halide, photographic composition comprising (a) silver nitrate, (b) a gelatino binder, and (c) an energy sensitive dye consisting essentially of a 4-(2,4-dinitrobenzylidene)-1-ethyl-1,4-dihydroquinoline dye.

13. A process of developing a latent image formed by imagewise exposure to light in an imagewise exposed, non-silver halide photographic element comprising a support having thereon a layer comprising (a) a silver salt of an organic acid or nitric acid oxidizing agent, (b) a binder, and (c) an energy sensitive dye represented by the following formula:

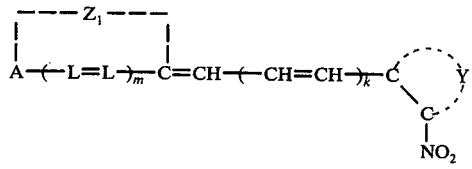

wherein:

(a) $k$ represents 0 or 1;

(b) $m$ represents 0 or 1;

(c) each L represents a methine group;

(d) A represents oxygen, sulfur or N—$R_1$;

(e) $R_1$ represents an alkyl group, an alkenyl group or an aryl group;

(f) $Z_1$ represents the nonmetallic atoms necessary to complete a basic, cyanine dye type heterocyclic nucleus forming a 5- or 6-membered heterocyclic ring whose skeletal atoms consist of the oxygen, sulfur or nitrogen atom of A, carbon atoms and one other atom chosen from the group consisting of carbon, oxygen, nitrogen, selenium and sulfur atoms, and (g) Y represents the atoms necessary to complete a nitro-substituted phenyl or naphthyl group, comprising contacting said element with a physical developer bath to develop said latent image.

14. The process of claim 13 wherein said physical developer bath contains silver halide.

15. The process of claim 14 wherein said physical developer bath contains a copper acetate solution.

* * * * *

UNITED STATES PATENT OFFICE

CERTIFICATE OF CORRECTION

Patent No. 4,095,981 Dated June 20, 1978

Inventor(s) Charles A. Goffe (deceased) Philip W. Jenkins et al.

It is certified that error appears in the above-identified patent and that said Letters Patent are hereby corrected as shown below:

Column 1, line 45, "722,371" should read ---772,371---; line 67, "photograhic" should read ---photographic---.

Column 2, line 34, "acitinic" should read ---actinic---; line 38, "precurser" should read ---precursor---.

Column 3, line 48, "This" should read ---The---.

Column 5, line 4, "acetoxyethyl" should read ---acetyloxyethyl---; line 42, "substitutents" should read ---substituents---.

Column 6, line 9, "5-ethoxybenzoxazle" should read --- 5-ethoxybenzoxazole ---.

Column 7, lines 45-50, the structure should read

---

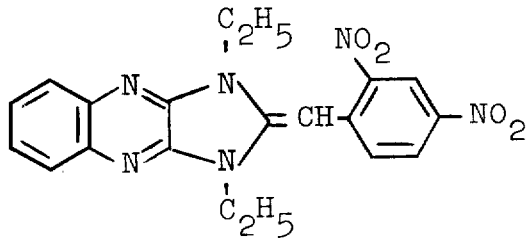

---.

UNITED STATES PATENT OFFICE

CERTIFICATE OF CORRECTION

Patent No. 4,095,981 Dated June 20, 1978

Inventor(s) Charles A. Goffe (deceased) Philip W. Jenkins et al.

It is certified that error appears in the above-identified patent and that said Letters Patent are hereby corrected as shown below:

Column 7, lines 61-67, the structure should read

--- 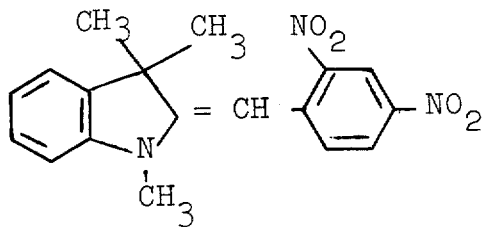 ---.

Column 8, lines 20-25, that part of the structure reading "$Na^{\ominus\oplus}$" should read --- $Na^{\oplus\ominus}$ ---.

Column 11, line 53, "each" should read ---reach---; line 61, "Belgium" should read ---Beguin---.

Column 12, line 48, "0.0006" should read ---0.006---.

Column 13, line 16, "1,2-dihydroimadazo[4,5-b] quinoxaline" should read --- 1,2-dihydroimidazo[4,5-b] quinoxaline ---.

Column 17, line 17, after "described" delete ".".

Column 18, line 33, "Acetone-tuluene" should read --- Acetone-toluene ---.

UNITED STATES PATENT OFFICE

CERTIFICATE OF CORRECTION

Patent No. 4,095,981 Dated June 20, 1978

Inventor(s) Charles A. Goffe (deceased), Philip W. Jenkins et al.

It is certified that error appears in the above-identified patent and that said Letters Patent are hereby corrected as shown below:

Column 21, lines 1-8, the structure should read

--- 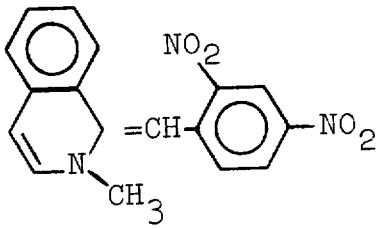 ---.

Column 22, line 23, "in shown" should read ---is shown---.

Column 22, Table III, Example 27, "1-ethyl-4-[γ-(2,4-dinitro-1-phenyl)allylidene]-1,4-dihydroxyquinoline" should read --- 1-ethyl-4-[γ-(2,4-dinitrophenyl)allylidene]-1,4-dihydroquinoline ---.

Column 22, Table III, Example 28, "15-30 sec." should read --- 30-60 sec. ---.

Column 23, the structure for Control C should read

--- 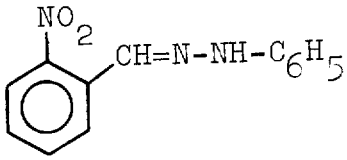 ---.

UNITED STATES PATENT OFFICE

CERTIFICATE OF CORRECTION

Patent No. 4,095,981 Dated June 20, 1978

Inventor(s) Charles A. Goffe (deceased), Philip W. Jenkins et al.

It is certified that error appears in the above-identified patent and that said Letters Patent are hereby corrected as shown below:

Column 23, the structure for Control I should read

---

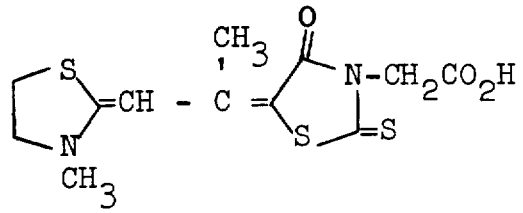

---.

Column 25, the structure for Control M should read

---

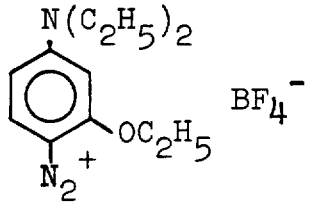

---.

Signed and Sealed this

Nineteenth Day of December 1978

[SEAL]

Attest:

RUTH C. MASON
Attesting Officer

DONALD W. BANNER
Commissioner of Patents and Trademarks